US006079190A

United States Patent [19]

Simpson

[11] Patent Number: 6,079,190

[45] Date of Patent: Jun. 27, 2000

[54] BANDAGE PACKAGE AND METHOD OF DISPENSING

[75] Inventor: Raymond Simpson, Oakpark, Ill.

[73] Assignee: Premium Promotions, Elk Grove, Ill.

[21] Appl. No.: 09/174,405

[22] Filed: Oct. 19, 1998

Related U.S. Application Data

[63] Continuation-in-part of application No. 09/130,445, Aug. 6, 1998, which is a continuation-in-part of application No. 08/999,846, Oct. 9, 1997, Pat. No. 5,979,699.

[51] Int. Cl.[7] ..... B65B 43/26; B65B 43/38; B65B 43/40

[52] U.S. Cl. ..... 53/492; 53/447; 53/540; 221/52; 221/60

[58] Field of Search ..... 221/52, 59, 60, 221/58, 63, 46, 45, 48; 206/445, 812; 53/447, 540, 541, 492

[56] References Cited

U.S. PATENT DOCUMENTS

| | | | |
|---|---|---|---|
| 2,027,671 | 1/1936 | Broeren | 221/59 |
| 2,153,278 | 4/1939 | Shelley | 221/52 |
| 2,237,424 | 4/1941 | Hope | 221/48 |
| 2,795,353 | 6/1957 | Tuttle | 221/46 |
| 5,165,570 | 11/1992 | Windorski et al. | 221/46 |
| 5,197,631 | 3/1993 | Mishima | 221/52 |
| 5,344,007 | 9/1994 | Nakamura et al. | 206/812 |
| 5,363,985 | 11/1994 | Cornell | 221/46 |
| 5,938,013 | 8/1999 | Palumbo et al. | 206/812 |

*Primary Examiner*—Eugene L. Kim
*Attorney, Agent, or Firm*—Johnathan Grant

[57] ABSTRACT

The present invention discloses a method for dispensing packaged bandages in a way that allows for the easy removal of the bandage from its package. The dispenser comprises walls defining a cavity adapted to receive the stack of sheets, a rectangular flat top wall having an opening through which the sheets may be individually dispensed, a flat bottom wall having approximately the same dimensions as the flat top wall, with the flat bottom wall being approximately parallel to the flat top wall, and resilient means to push the stack of said sheets to the opening in the top wall of the dispenser.

20 Claims, 2 Drawing Sheets

BANDAGE PACKAGE AND METHOD OF DISPENSING

This application is a continuation in part of U.S. application Ser. No. 09/130,445, filed Aug. 6, 1998, for "A Method For Activating Scents From A Scented Coupon by Means of A Coupon Dispenser" which is a continuation in part of U.S. application Ser. No. 08/999,846, now U.S. Pat. No. 5,979,699. filed Oct. 9, 1997, entitled "A Dispenser Box."

FIELD OF THE INVENTION

The present invention discloses an package or wrapper for an bandage and a method of dispensing the bandage.

DESCRIPTION OF THE PRIOR ART

One of the problems in the use of bandages is the difficulty in removing a bandage from its wrapper or package, particularly when a person has a cut on their hand or finger. Often, the bandage gets stuck on itself, or the person has bled all over the box of bandages. In the meantime, the person's cut or injury is exposed to the air, thereby risking infection.

Over the years, there have been many dispenser boxes developed for the dispensing of sheets of paper or coupons of some sort.

To accommodate consumer needs, there has been a number of different paper dispensing devices over the years for dispensing coupons or tickets.

U.S. Pat. No. 2,253,742 (W. H. West et al.) discloses a dispenser for interfolded paper. The dispenser comprises a vertically disposed container having a dispensing opening and a spring-actuated follower plate in the container adapted to support a vertically disposed stack of interfolded paper sheets. A plate is secured to the under side of the cover at one side of the dispensing opening, and engages the upper end of the stack while maintaining a predetermined spacing between the stack and the dispensing opening. A second plate is secured to the underside of the cover, the ends of the plates adjacent the dispensing opening being rounded to form deflecting surfaces.

U.S. Pat. No. 5,390,820 (Wright et al.) discloses an elevating dispensing device for flexible sheet material. The dispensing aperture has flaps to retain the end of successively drawn sheets above the aperture for ease of withdrawal. The stack of sheets rests within the carton on an elevating platform which is flexibly attached on two opposing sides to the base of the adjacent side walls of the carton by flexibly folded extension panels which allow upward urging of the elevating platform.

U.S. Pat. No. 2,237,424 (S. N. Hope) discloses a sheet dispenser comprising a casing adapted to contain a pack of interfolded sheets and having opposite end walls with inwardly directed embossments adjacent to the opposite sides of the casing. A pair of cover members extend between the casing end walls and having end walls with outwardly directed embossments adapted to register with the casing embossments. A coiled spring for each cover member urges the cover member against the pack, with the spring surrounding a cooperating pair of the embossments on the casing and cover member.

U.S. Pat. No. 4,993,590 (Windorski), and U.S. Pat. No. 5,165,570 (Windorski et al.) are for dispensers for a stack of partially adhesive coated sheets stacked with the adhesive coating on each successive sheet disposed along alternate opposite sides of the stack and releasably adhering the sheets together.

In U.S. Pat. No. 4,993,590, the dispenser for adhesive coated sheets has opposed end surfaces having parallel upper ends adapted to be engaged by the opposite sides of the stack with the with the top sheets in the stack parallel to the adjacent upper ends, with the opposed end surfaces diverging slightly from each other toward the upper ends of the end surfaces to cause movement of the end portions of the stack along the end surfaces toward the upper ends in response to forces applied to the stack to sequentially remove sheets from the stack through the opening.

Additionally, there have been attempts to improve the packaging of bandages.

U.S. Pat. No. 4,826,009 (Young) discloses a container assembly comprising a dressing (the bandage), a base sheet placed on one side of the dressing of a material relatively non-adherent to the dressing, and a cover sheet placed on the other side of the dressing of a material relatively adherent to the dressing. Mores specifically, the container assembly comprises a dressing; a base sheet placed on one side of the dressing material relatively non-adherent to the dressing and being free of sealing relationship with itself, a cover sheet placed on the other side of a material relatively adherent to the dressing and readily removable from the dressing; and a package having a cavity to receive the dressing, base sheet and cover sheet, the package enclosing and being separate from the dressing, base sheet, and cover sheet, wherein the base sheet has a pair of flaps adjacent opposed sides, and a flap adjacent one end, the flaps being folded over the cover sheet.

SUMMARY OF THE INVENTION

The present invention discloses a method for dispensing bandages using a dispenser which allows the bandages to be individually removed without the chance of another bandage being removed at the same time. By having a dispenser and a bandage package which allows for the easy removal and application of the bandage to an injury, the consumer will be able to apply the bandage to the wounded area of the body with much less difficulty, thereby lessening the chances of infection.

In one embodiment of the invention, the individual bandages are specially packaged, wherein, the bandage package comprises a cavity to receive the bandage, the bandage package having a flat bottom sheet, a top sheet, with the top sheet having an opening through which one end of the bandage extends, and a flap attached to the top sheet which is folded back over on itself. This flap has a tab, thereby allowing the flap to be opened when the tab is pulled as the bandage package is being removed from the dispenser.

The dispenser itself allows for the easy removal of the coupons, bandages, or any other essentially flat material.

In the proposed invention, there is no "divergence" of any possible equivalent end surfaces of the dispenser. The surfaces of the proposed invention are all either perpendicular or parallel to each other, except for the semi-circular piece of styrene that keeps pressure on the coupons so that they stay up against the opening of the box for easy withdrawal from the dispenser. In one embodiment of the invention, the inside of the dispenser is a triangular shape that assists the semi-circular piece of styrene in keeping an upward pressure on the coupons which helps the coupons "sit up" in the dispenser box to allow them to be easily pulled out by a folded edge of the coupon.

In another one embodiment of the invention, the design of the dispenser allows it to be printed, die-cut and folded out of one piece of paper stock.

In yet another embodiment of the invention, the dispenser contains a header piece for hanging on a shelf and for adding graphics. This header piece can be located on several other panels of the dispenser box.

DESCRIPTION OF THE PREFERRED EMBODIMENT

Figure 1:
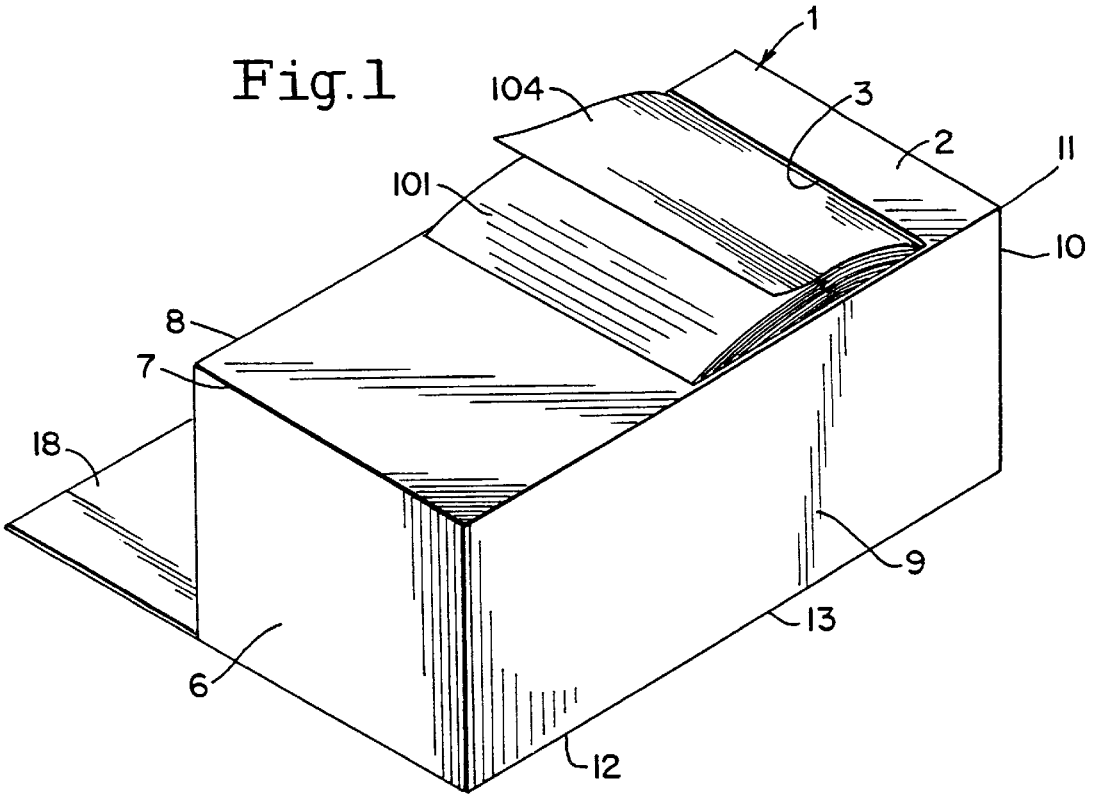
FIG. 1 is a perspective view of the coupon dispenser.
Figure 2:
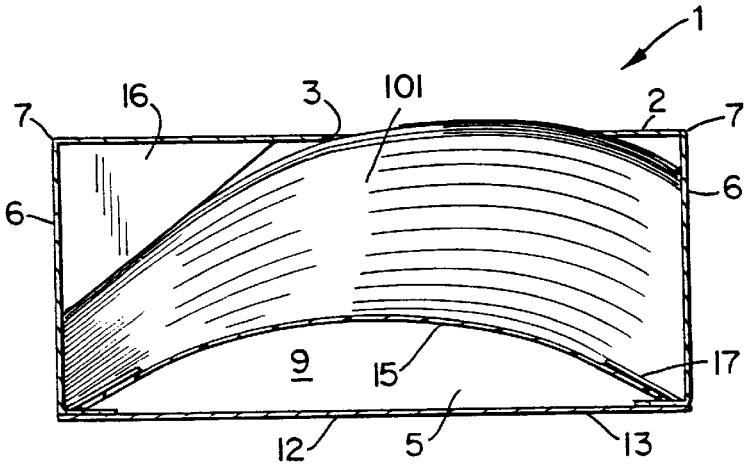
FIG. 2 is a cross-sectional view of the coupon dispenser.
Figure 3:
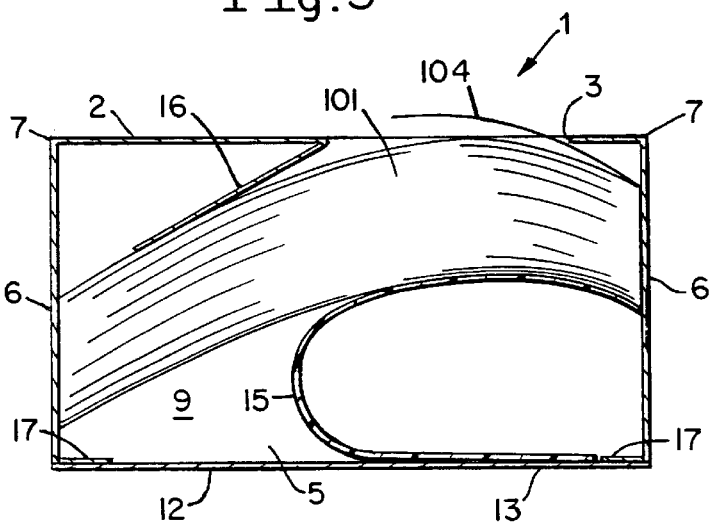
FIG. 3 is another view of the coupon dispenser.
Figure 4:
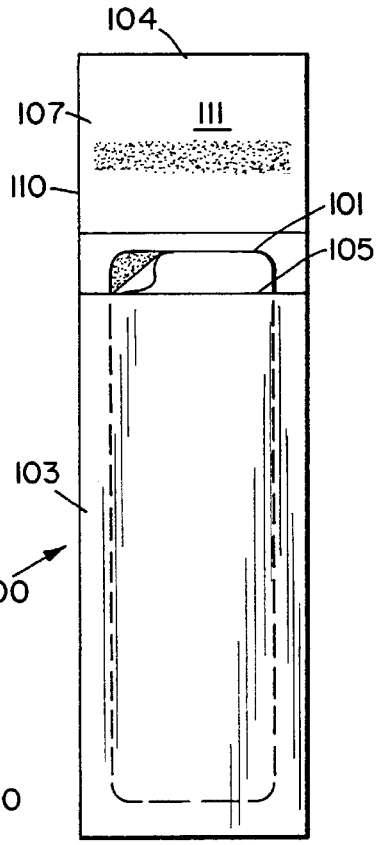
FIG. 4 is a perspective view of one of the bandage packages.
Figure 5:
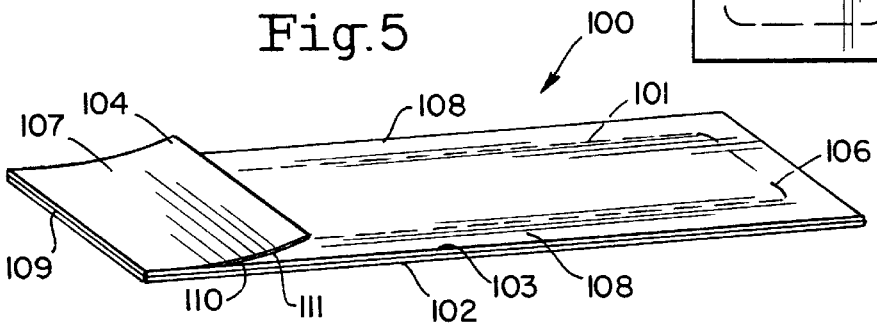
FIG. 5 is a cross-sectional view of the bandage packages.
Figure 6:
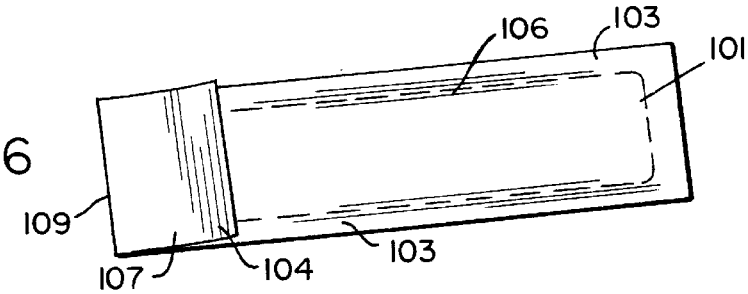
FIG. 6 is another perspective view of one of the bandage packages.

Referring to FIGS. 1–4, the dispenser 1 comprises a top section 2 having an opening 3 through which bandages 101 may be dispensed. The dispenser has a stack of bandages 101 disposed one on top of another and folded at a specific length, allowing for the dispensing of individual bandages 101.

The walls of the dispenser define a cavity 5 adapted to receive the stack of bandages 101. The dispenser 1 is generally rectangular or box shaped, having a large enough interior area to store a number of bandages 101. A rectangular flat top wall 3 has an opening 3 through which the bandages 101 may be individually dispensed.

The dispenser 1 has two short flat end walls 6. Edges 7 of these short flat end walls 6 are positioned perpendicularly to edges 8 of the width of the flat top wall 2 at opposite ends of the flat top wall 2. The two short flat end walls 6 are parallel to each other, with each of the two short flat end walls 6 having the same dimensions as the other flat end wall.

Between the two short flat end walls 6 are two long flat side walls 9. The edges 10 of each of the two long flat side walls 9 are positioned along the edges of the length 11 of the top wall 2 with the long flat side walls 9 positioned perpendicularly to the flat top wall 2. Each of the long side walls 9 are located on opposite sides of the width of the top wall 2, such that the two long side walls 9 are parallel to each other.

The dispenser 1 also has a flat bottom wall 12 having approximately the same dimensions as the flat top wall 2, without an opening. The flat bottom wall 12 is approximately parallel to the flat top wall 2, wherein one edge 13 along the length of the flat bottom wall is affixed to the bottom of the dispenser 1. The stack of bandages 101 is positioned between the two short end walls 6.

In a preferred embodiment of the invention, a resilient means is used to push the stack of bandages 101 up to the opening 3 in the top wall 2 of the dispenser 1. In one embodiment of the invention, the means to push the bandages 101 to the opening of the dispenser is an arc type structure 15 positioned underneath the stack of bandages 101. This arc type structure 15 is positioned between the short end walls 6 and above the flat bottom wall 12. The peak of the arc type structure 15 is in communication with the stack of bandages 101, pushing the stack of bandages 101 towards the opening 3 in the dispenser 1. In another embodiment of the invention, the arc type structure 15 may be flexed and inserted between the stack of bandages 101 and the bottom wall 12.

Another preferred feature of the dispenser directs the stack of bandages 101 towards the opening in the top wall of the dispenser. More preferably, this feature is an angular formation 16 positioned between one of the end walls 6 and the top wall 2, to direct the stack of bandages 101 towards the opening 3 in the top wall 2 of the dispenser 1. Preferably, this angular formation 16 is a triangular shaped piece 16 positioned between the end wall 6 and the top wall 2. This triangular shaped piece is most preferably in the form of a right triangle which fits into one of the top corners of the dispenser 1. In a more preferable embodiment of the invention, the angular formation 16 is the material from opening 3 folded back toward wall 6.

The exterior walls of the dispenser 1 may be made out of one unitary piece of material wherein the material is selected from the group consisting of paper, styrene, and plastic. In line with this arrangement, it is a preferred embodiment to have flaps or tongues 17 on one edge of each wall so that the unitary piece of material may be folded into the box like dispenser. In such an arrangement, the bottom wall of the device may be secured in place to an overlapping flap or tongue by means of an adhesive of some sort such as tape or glue. In yet another embodiment of the invention, the box may have slits 17 into which the flaps or tongues are inserted to hold the dispenser 1 in its box-like shape.

The dispenser may also have a header 18 for displaying the dispenser 1. This header 18 may be positioned along virtually any wall or edge of the dispenser 1 but it is most preferable to have the header positioned along the same plane as that of the bottom section 12, to allow for the display of the dispenser 1.

The package 100 for the bandage 101 comprises a flat bottom sheet 102, a top sheet 103 and a cavity 106 between said top sheet 103 and said flat bottom sheet 102 to receive the bandage 101. The top sheet 103 and the bottom sheet 102 of the package 100 are glued together along the edges 108. The top sheet 103 has an opening 105 through which one end of the bandage 101 extends from the cavity 106. A flap 107 is adhered to the outer side 110 of the proximal end 109 of the top sheet 103. The proximal end 109 of the top sheet 103 to which the flap 107 is attached is folded over so as to reside on top of the outer side 110 of the top sheet 103. The underside 111 of flap 107 is secured to the outer side 110 of the top sheet 103 by an adhesive or glue along the edges or in the middle of the flap 107. Flap 107 has a tab 104 not secured to the outer side 110 of top sheet 103 thereby allowing the flap 107 to be opened when the tab 104 is pulled as the bandage package 100 is being removed from the dispenser. This tab 104 may preferably be a continuum or integral with the flap 107 or the tab 104 may be a adhered to the flap 107.

The bandage 101 may have an adhesive on its underside 113, covered by a removable non-stick material. It is also preferred that the bandage be elongated (rectangular) or square in shape. However, other shaped bandages may be used.

This bandage package 100 is opened as the bandage package 100 is removed from the dispenser 1. More specifically, the bandage package 100 is removed from the dispenser 1 by pulling on the tab 104. As the bandage package 100 is removed from the dispenser by pulling on the tab 104, the flap 107 begins to separate from the top sheet 103. This exposes the bandage 101, allowing the bandage 101 to be easily removed from the opening 105 in the package 100.

Many modifications and variations of the present invention are possible in light of the above teachings. It is, therefore, to be understood within the scope of the appended claims the invention may be protected otherwise than as specifically described.

What is claimed is:

1. A method for dispensing individual packaged bandages as they are removed from a dispenser, said method comprising:

a) stacking said packaged bandages in the dispenser, each said packaged bandage in a stack comprising:
- a bandage; and
- a bandage package for containing said bandage, said package comprising
  - a flat bottom sheet,
  - a top sheet, said top sheet adhered along the edges to said bottom sheet,
  - a cavity between said top sheet and said bottom sheet for receiving said bandage,
  - an opening in said top sheet through which one end of said bandage extends,
  - a flap adhered to an outer side of a proximal end of the top sheet, the proximal end of the top sheet to which the flap is attached being folded over so as to reside on top of said outer side of the top sheet,
  - a tab integral or attached to the distal end of said flap, said tab being free from said outer side of said top sheet thereby allowing the flap to be opened when the tab is pulled as the bandage package is being removed from the dispenser; and b) pulling said tab from said top sheet to remove said bandage package from said dispenser, said pulling separating the flap from said top sheet, thereby exposing said opening in said package, from which said bandage may be removed.

2. The method of dispensing the packaged bandages of claim 1, wherein said dispenser comprises:

a rectangular flat top wall having an opening through which said bandages may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall;

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall; and a flat bottom wall having approximately the same dimensions as the flat top wall, said flat bottom wall being approximately parallel to said flat top wall, wherein at least one edge along the length of said flat bottom wall is affixed to the bottom of said dispenser.

3. The method for dispensing the packaged bandages of claim 1, further comprising pushing said stack of said packaged bandages to the opening in the top wall of the dispenser by a resilient means.

4. The method for dispensing the packaged bandages of claim 3, wherein said means to push said stack of said packaged bandages to the opening in the top wall of the dispenser is an arc type structure positioned underneath said stack of said packaged bandages, said arc type structure positioned between said short flat end walls and above said flat bottom wall, wherein said arc type structure is in communication with said stack of packaged bandages, pushing said stack of said packaged bandages towards the opening in said flat top wall.

5. The method for dispensing the packaged bandages of claim 3, wherein said means to push said stack of said packaged bandages to the opening in the top wall of the dispenser is an arc type structure positioned underneath said stack of said packaged bandages, said arc type structure positioned between said stack of said packaged bandages and above said flat bottom wall, wherein one end of said arc type structure is in communication with said stack of said packaged bandages, pushing said stack of said packaged bandages towards the opening in said flat top wall.

6. The method for dispensing the packaged bandages of claim 1, further comprising a means for directing said stack of said packaged bandages towards the opening in the top wall of the dispenser.

7. The method for dispensing the packaged bandages of claim 5, further comprising an angular formation positioned between one of said end walls and said top wall, for the purpose of directing said stack of said packaged bandages towards said opening in the top wall of the dispenser.

8. The method for dispensing the packaged bandages of claim 7, further comprising a triangular shaped piece positioned between one of said end walls and said top wall, for the purpose of directing said stack of said packaged bandages towards said opening in the top wall of the dispenser.

9. The method of dispensing the packaged bandages of claim 7, wherein said angular formation is the material from said opening folded back toward said wall.

10. The method of dispensing the packaged bandages of claim 1, wherein said dispenser is made of one unitary piece of material.

11. The method of dispensing the packaged bandages of claim 1, further comprising side flaps positioned on a bottom section of at least one of said walls.

12. The method of dispensing the packaged bandages of claim 1, wherein said dispenser is comprised of a material selected from the group consisting of paper, styrene, and plastic.

13. The method for dispensing the packaged bandages of claim 1, wherein said bandages are independent of each other.

14. The method for dispensing the packaged bandages of claim 1, wherein the dispenser comprises:

walls defining a cavity adapted to receive the stack of said bandage packages, said walls including:
- a rectangular flat top wall having an opening through which said bandage packages may be individually dispensed;
- two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall:
- two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser;

a resilient flexible arc type structure, said arc type structure having essentially a solid rectangular shape when flat, said arc type structure pushing said stack of said packaged bandages to the opening in the top wall of the dispenser, said arc type structure positioned underneath said stack of said bandage packages, said arc type structure positioned between said short flat end walls and above said flat bottom wall, wherein said arc type structure is in communication with said bandage packages, pushing said stack of bandage packages towards the opening in said flat top wall;

said stack of said bandage packages being positioned between said two short end walls within said dispenser and wherein each said bandage packages from said stack of bandage packages is disposed one said flexible bandage on top of another said bandage package, each said bandage package being independent from one another.

15. The method for dispensing the packaged bandages of claim 14, wherein said dispenser is made of one unitary piece of material, aside from the arc type structure.

16. The method for dispensing the packaged bandages of claim 1, wherein said dispenser comprises:

walls defining a cavity adapted to receive the stack, said walls including:

a rectangular flat top wall having an opening through which said packaged bandages may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall:

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser;

a resilient element to push said stack of said packaged bandages to the opening in the top wall of the dispenser, said means being an arc type structure positioned underneath said stack of said packaged bandages and between said stack of said packaged bandages and the flat bottom wall, wherein one end of said arc type structure is in communication with said stack of said packaged bandages, pushing said stack of said packaged bandages towards the opening in said flat top wall;

an angular formation positioned between one of said end walls and said top wall, for the purpose of directing said stack of said packaged bandages towards said opening in the top wall of the dispenser, wherein said angular formation is the material from said opening folded back toward said wall, and wherein said stack of said of said packaged bandages is positioned between said two short end walls within said dispenser.

17. The method for dispensing the packaged bandages of claim 1, wherein the dispenser comprises:

walls defining a cavity adapted to receive the stack, said walls including:

a rectangular flat top wall having an opening through which said packaged bandages may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall:

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser;

side flaps positioned on a bottom section of at least one of said walls, wherein said stack of said packaged bandages is positioned between said two short end walls within said dispenser; and a resilient element to push said stack of said packaged bandages to the opening in the top wall of the dispenser, said element being an arc type structure positioned underneath said stack of said packaged bandages and between said stack of said packaged bandages and the flat bottom wall, wherein one end of said arc type structure is in communication with said stack of packaged bandages, pushing said stack of packaged bandages towards the opening in said flat top wall.

18. The method for dispensing the packaged bandages of claim 1, wherein one side of end of said arc type structure is in communication with the bottom of said stack of packaged bandages, and wherein said apex of said arc type structure is facing one of said side walls.

19. A method for dispensing the packaged bandages of claim 1, wherein said dispenser comprises:

walls defining a cavity adapted to receive the stack of said packaged bandages, said walls including:

a rectangular flat top wall having an opening through which said packaged bandages may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall;

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser; and resilient element to push said stack of said packaged bandages to the opening in the top wall of the dispenser; and wherein said stack of said packaged bandages is positioned between said two short end walls within said dispenser.

20. A bandage package comprising: a bandage; and a package, said package comprising a flat bottom sheet, a top sheet, said top sheet adhered along the edges to said bottom sheet, a cavity between said top sheet and said bottom sheet for receiving said bandage, an opening in said top sheet through which one end of said bandage extends, a flap adhered to an outer side of a proximal end of the top sheet, the proximal end of the top sheet to which the flap is attached being folded over so as to reside on top of said outer side of the top sheet, a tab integral or attached to the distal end of said flap, said tab being free from said outer side of said top sheet thereby allowing the flap to be opened when the tab is pulled as the bandage package is being removed from dispenser.

* * * * *